United States Patent [19]

Backman

[11] Patent Number: 4,838,412

[45] Date of Patent: Jun. 13, 1989

[54] CONVEYOR

[75] Inventor: Ralf Backman, Eksjö, Sweden

[73] Assignee: Wamac AB, Sweden

[21] Appl. No.: 130,421

[22] Filed: Dec. 9, 1987

[30] Foreign Application Priority Data

Jan. 23, 1987 [SE] Sweden ..... 8700262

[51] Int. Cl.[4] ..... B65G 15/60

[52] U.S. Cl. ..... 198/838; 104/94; 104/106; 104/119

[58] Field of Search ..... 198/838, 845; 104/94, 104/106-109, 118, 119

[56] References Cited

U.S. PATENT DOCUMENTS

| | | | |
|---|---|---|---|
| 2,973,721 | 3/1961 | Wagter | 104/94 |
| 3,043,408 | 7/1962 | Attwood | 104/107 |
| 3,884,153 | 5/1975 | Sugimoto | 104/118 |
| 4,000,702 | 1/1977 | Mackintosh | 104/107 |
| 4,150,625 | 4/1979 | Cowan | 104/119 |
| 4,640,196 | 2/1987 | Dehne | 104/94 |
| 4,746,007 | 5/1988 | Houseman | 198/852 |

FOREIGN PATENT DOCUMENTS

| | | | |
|---|---|---|---|
| 0025676 | 3/1981 | European Pat. Off. . | |
| 1073522 | 1/1960 | Fed. Rep. of Germany . | |
| 1534036 | 2/1973 | Fed. Rep. of Germany . | |
| 2495082 | 6/1982 | France | 104/107 |
| 8501538-G | 2/1986 | Sweden . | |
| 723734 | 2/1955 | United Kingdom . | |
| 2167371A | 5/1986 | United Kingdom . | |

*Primary Examiner*—Joseph E. Valenza

*Attorney, Agent, or Firm*—Ostrolenk, Faber, Gerb & Soffen

[57] ABSTRACT

The present invention relates to a conveyor rail intended for handling individual objects. The rail is composed of straight and curved modules consisting of quadratic sections (1), preferably of aluminium, with chain guides (4, 5, 6, 7) arranged on each side, This enables a single type of curved profile to be utilized for curves in any direction.

7 Claims, 2 Drawing Sheets

Figure 1:
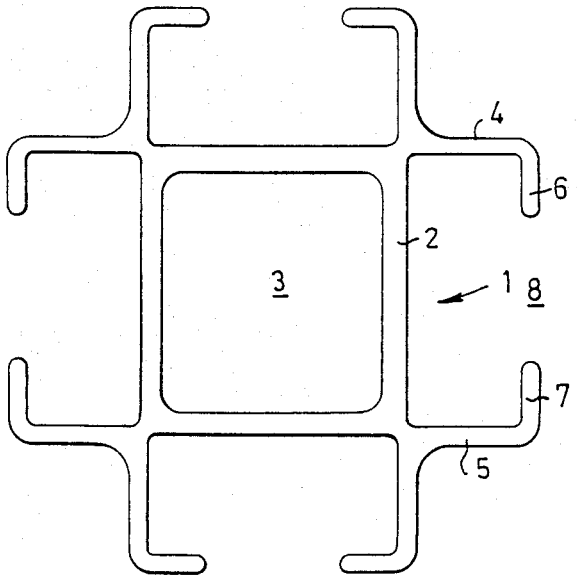

CONVEYOR invention relates to a rail for guiding a chain in a conveyor system intended for handling individual objects by means of which the objects can be moved in optional paths.

Conveyor and handling systems comprising chain conveyors have many applications and the chains in particular are in a phase of intense development. An example of this is EP patent application No. 86 850 339.2 describing a flat link articulated chain provided on each link with grippers for printed sheets such as daily newspapers. Each link runs on wheels in a rail, the grippers protruding freely between the two portions of the rail holding the wheels. The rail, suspended from the ceiling, in brackets or on pillars, consists of a slotted section with rectangular or quadratic or quadrilateral cross section. According to a procedure described in said application, a rail is assembled to provide a forward and return section, four identical elements being welded together to form a unit.

The course followed by transport tracks in handling systems is generally complicated and is determined by the location of the various stations along the track. The track is assembled and extended by bending section parts which are then combined to form a single section. Bending asymmetrical C-sections is a complicated procedure which is both troublesome and expensive.

The object of the present invention is to produce a conveyor rail which is simple and convenient to erect, easy to assemble and dismantle and to extend and/or modify.

These and other objects of the invention are achieved with the conveyor rail according to the present invention comprising a plurality of prefabricated modules connected together, the modules consisting of straight and curved modules, there being only one type of curved module, the radius of curvature of which is determined by the smallest curve radius of the chain being used, and each module constituting a section with quadratic of quadrilateral cross section and having a guide to fit the relevant chain, located on each of its four sides.

According to a preferred embodiment of the invention the modules are made of aluminium. They can therefore be shaped in a single step and are light-weight.

Within the scope of the invention, the guides arranged on the sides of the section can be freely adjusted to the shape and operating method of the chain used. If a flat link articulated chain is used, with grippers for individual objects arranged on each of the links, the guide should preferably be in the form of two L-shaped sections with the free shanks facing each other and defining a space between them through which the grippers can pass.

Several advantages are gained through the design according to the present invention. Only one type of curved module need be kept in stock and can be used for all types of curves, i.e. to left or right in horizontal plane and up or down in vertical plane, and a choice is offered as to whether the inner or outer guide in relation to the curve shall be used. Only two basic elements are required to assemble the track, one straight and one curved.

Additional advantages are that the free sides of the rail can be utilized to join the parts in a simple manner without encroaching on the sides of the section carrying the chain. Furthermore, the section sides not being used for other purposes can be used for suspending or securing the rail. The opposite side of the rail can also be used for returning the chain.

Constructing the section in the form of a pipe allows the central cavity to be utilized as cable drum for electric cables to the means driving the chain, for instance, or for other purposes.

Figure 2:
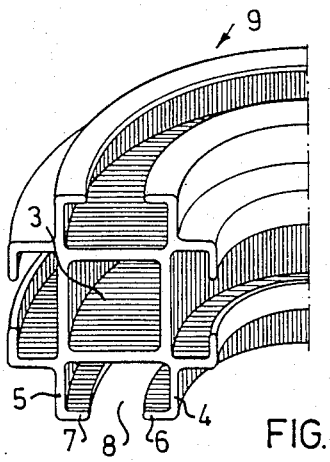
Figure 3:
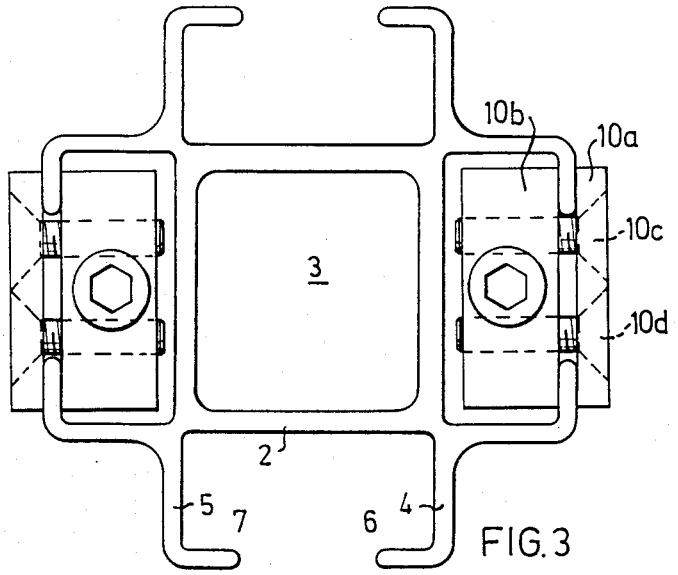
Figure 4:
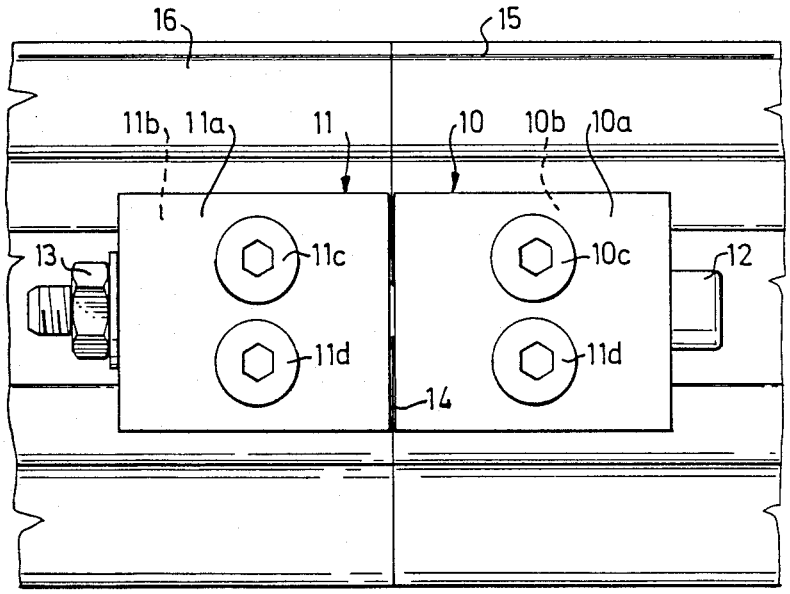

Additional features, advantages and objects of the present invention will be revealed in the following detailed description with reference to the accompanying drawings, in which FIG. 1 shows a cross sectional view through a rail according to the present invention, FIG. 2 shows an end view of a curved rail module, FIG. 3 shows a section along the line III—III in FIG. 4, through the joint between two rail modules, and FIG. 4 shows a side view of the joint embodiment shown in cross section in FIG. 3.

FIG. 1 shows a cross-sectional view through a rail in accordance with the present invention, constituting a pipe-shaped section 1 having quadratic or quadrilateral cross section, the sides 2 surrounding a cavity 3.

Each of the sides 2 is provided with two L-shaped sections 4, 5 with the free shanks 6, 7 facing each other to form a space 8 between them. Together, the L-shaped sections form a guide for a flat link articulated chain in which each link runs on wheels and carries a gripper which can run freely in the space 8. This is repeated on each of the four sides of the pipe shaped section.

The invention is not, however, limited to this form of chain guide. Any desired guide suited to the transport chain being used can be applied on the sides of the section.

The section is preferably made of aluminium, a considerable advantage being that it can then be made in a single step. However, the choice of material is not decisive to the inventive concept.

The rail according to the invention is formed of a number of curved and straight modules or section pieces. FIG. 2 shows an end view of a curved section 9. The figure is included only to facilitate the reader's imagining the same curved profile being used for any change of direction in the track, i.e. up/down, left/right and along inside/outside.

Considerable financial advantage is gained through the rail according to the present invention since only two different types of section elements are required to assemble a track with optional extension in space. With conventional techniques, four different curved sections are required. Other advantages of the design according to the invention are the vastly simplified assembly since a number of modules can easily be joined by bolted joints or the like, leaving sides free for suspension, and that cables and the like can be drawn through the central cavity.

FIGS. 3 and 4 show an example of a joint allowing simple assembly of the track sections. The joint comprises two main elements 10, 11, these being in two parts 10*a*, 10*b* and 11*a*, 11*b*, respectively. The main parts are secured by bolts 10*c*, 10*d* and 11*c*, 11*d*, respectively, on the L-shaped section elements 4, 5 forming the guide. The main elements 10, 11 are joined together by a bolt 12 with nut 13, the main elements being fitted on the guides so that a space 14 is formed between the main elements of the joint, as shown in FIG. 4. The rail modules 15, 16 can then be pressed together to achieve a perfect join.

The modules may of course be joined in some other suitable manner or the joints adapted to other guides used.

To further reinforce and improve the joints between the various modules, a guide overlapping the joint area may be inserted into the free cavity in the modules.

Because of the quadratic cross section, it is also possible to twist a straight module 90° or 180° for example around the axis thereof in a relatively simple manner, when it is desired to let a portion of the rail run helically, for example in order to move the grippers from the bottom side to the top side of the rail in a relatively short distance.

Furthermore, it is appreciated that the curved modules could be bent around 90° for example, but it should be clear that other bending angles are possible and useful for the construction of a rail extending in an optional, possibly closed path.

Thus, the bent modules could to advantage extend around 30° or 45°, but such modules can easily be cut from a 90° module. Therefore, two types, namely straight and 90° modules satisfy the basic needs for building a rail in the inventive context.

I claim:

1. A rail for guiding a chain, comprising a plurality of prefabricated rail modules detachably connected together, and each module comprising a section with a quadratic, quadrilateral, hollow cross section with four sides and having a respective guide for receiving a chain therein located on each of its four sides.

2. A rail as claimed in claim 1, wherein the modules are detachably connected together by means of bolted joints.

3. A rail as claimed in claim 1, wherein the modules are made of aluminium.

4. A rail as claimed in claim 1, wherein each guide comprises two L-shaped sections arranged on each respective side of the rail, extending in the longitudinal direction of the rail, wherein each L-shaped section has a free shank, and the free shanks of the two L-shaped sections on each side of the rail facing each other and there defining a space between them.

5. A rail as claimed in claim 1, wherein the four sides of the section surround a cavity.

6. The rail of claim 1, wherein at least some of the modules curve in shape along their length.

7. The rail of claim 6, wherein all of the curved modules are of one type of curvature.

* * * * *